US006145424A

United States Patent [19]

Matsuda et al.

[11] Patent Number: 6,145,424

[45] **Date of Patent: *Nov. 14, 2000**

[54] PUNCHING MACHINE AND METHOD THEREOF

[75] Inventors: Morikatsu Matsuda; Eiji Matsuno, both of Kanagawa, Japan

[73] Assignees: Amada Company, Limited; Amada Engineering Center Co., Ltd., both of Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,029

[22] PCT Filed: Nov. 18, 1996

[86] PCT No.: PCT/JP96/03373

§ 371 Date: Aug. 25, 1997

§ 102(e) Date: Aug. 25, 1997

[87] PCT Pub. No.: WO97/18909

PCT Pub. Date: May 29, 1997

[30] Foreign Application Priority Data

Nov. 20, 1995 [JP] Japan ..... 7-301393

[51] Int. Cl.[7] ..... B26D 7/02; B21D 43/11; B65H 23/18

[52] U.S. Cl. ..... 83/227; 83/175; 83/220; 83/234; 83/240; 83/263; 83/277; 83/412; 83/424; 83/437.4; 83/549; 83/560; 83/631; 226/37; 226/112; 269/58; 269/153

[58] Field of Search ..... 83/55, 30, 34, 83/35, 50, 18, 549, 618, 627, 631, 206, 277, 175, 559, 560, 685, 219, 220, 227, 228, 213, 214, 234, 239, 240, 255, 263, 412, 424, 437.4, 534; 226/37, 112; 269/32, 58, 73, 153; 464/753

[56] References Cited

U.S. PATENT DOCUMENTS

| | | | |
|---|---|---|---|
| 3,448,645 | 6/1969 | Graf et al. | 83/618 X |
| 3,775,225 | 11/1973 | Schott, Jr. | 83/627 X |
| 4,274,801 | 6/1981 | Herb et al. | 269/73 X |

(List continued on next page.)

FOREIGN PATENT DOCUMENTS

| | | | |
|---|---|---|---|
| 0 100 283 | 2/1984 | European Pat. Off. . | |
| 0552103 | 7/1993 | European Pat. Off. . | |
| 59-47032 | 3/1984 | Japan . | |
| 59-44938 | 11/1984 | Japan . | |
| 59-45449 | 11/1984 | Japan . | |
| 62-32661 | 8/1987 | Japan . | |
| 403264298 | 11/1991 | Japan | 83/55 |
| 2155838 | 10/1985 | United Kingdom | 83/412 |
| 2 168 919 | 7/1986 | United Kingdom . | |
| 86/00547 | 1/1986 | WIPO | 83/277 |
| 93/06978 | 4/1993 | WIPO | 83/618 |

OTHER PUBLICATIONS

European Search Report dated Dec. 9, 1998.

*Primary Examiner*—Rinaldi H. Rada
*Assistant Examiner*—Charles Goodman
*Attorney, Agent, or Firm*—Blank Rome Comisky & McCauley LLP

[57] ABSTRACT

A punching machine includes a body frame having a table to support a workpiece. First and second work movement positioning apparatuses are mounted at both sides to move and position the workpiece in a direction of axis X. A work head is mounted on the body frame and has a ram and a tool. The work head moves on the body frame in a direction of axis Y, which is perpendicular to axis X. The first and second work movement positioning apparatuses are arranged in series in the direction of axis X. The workpiece is clamped by the first positioning apparatus, moved in the direction of axis X, punched, clamped by the second positioning apparatus, unclamped by the first positioning apparatus, and moved further in the direction of axis X.

2 Claims, 7 Drawing Sheets

U.S. PATENT DOCUMENTS

| | | | |
|---|---|---|---|
| 4,423,546 | 1/1984 | Scott et al. | 29/568 |
| 4,434,693 | 3/1984 | Hosoi et al. | 269/73 X |
| 4,503,741 | 3/1985 | Hunter et al. | 83/549 |
| 4,519,284 | 5/1985 | Hunter et al. . | |
| 4,523,749 | 6/1985 | Kindgren et al. . | |
| 4,524,656 | 6/1985 | Del Fabro et al. | 83/277 X |
| 4,532,843 | 8/1985 | Miyama | 83/549 X |
| 4,583,719 | 4/1986 | Klingel . | |
| 4,588,070 | 5/1986 | Smith | 414/753 X |
| 4,646,600 | 3/1987 | Flick et al. | 83/549 X |
| 4,691,817 | 9/1987 | Haar | 83/206 X |
| 4,700,441 | 10/1987 | Ikeda et al. | 83/549 X |
| 4,802,567 | 2/1989 | Ikeda et al. . | |
| 5,027,683 | 7/1991 | Kakimoto | 83/549 X |
| 5,193,426 | 3/1993 | Dunn | 83/277 |
| 5,301,585 | 4/1994 | Hosaka | 83/549 |
| 5,379,510 | 1/1995 | Berge | 83/277 X |
| 5,529,005 | 6/1996 | Saotome et al. | 83/18 X |

PUNCHING MACHINE AND METHOD THEREOF

TECHNICAL FIELD

The present invention relates to a punching machine and a method thereof which can move a work head comprising a ram and a tool in the direction of axis Y, and further can move a work clamp apparatus clamping a work in the direction of axis X.

BACKGROUND ART

Conventionally, as punching machines, a work head thereof comprising a ram and a tool is moved in the direction of axis Y, and a work clamp apparatus thereof clamping a work is moved in the direction of axis X, thereby, a work can be punched. This kind of punching machines are known in, for example, a Japanese Patent Publication No. 59-44938, a Japanese Patent Publication No. 59-45449 and so on.

According to this type of punching machine, in order to punch a thin and long work which is punched with few holes, it is necessary to punch the work at high speed. In such high-speed punching, there is a problem how to move the work clamp apparatus in the direction of axis X.

For example, it is very difficult to move at high speed a work of which dimension is 5,000×450 mm and thickness is 0.4 mm, in the directions of axis X and Y. Especially, it is difficult to move the work in the direction of the shorter dimension thereof.

In order to avoid for moving the work in the direction of the shorter dimension, the work head comprising the ram and the tool is moved in the direction of axis Y. However, when a work clamp apparatus is moved at high speed in the direction of axis X, the work head and the work clamp apparatus are interfered with each other, which are in a dangerous state. Further, a dead zone exists so that it is not possible to punch the work. Furthermore, there is a problem that it is not possible to use a tool of a plurality of tools in the work head, located farthest from the work clamp apparatus.

DISCLOSURE OF INVENTION

It is an object of the present invention to provide a punching machine and a method thereof which can move a work clamp apparatus clamping a work in the direction of axis X without interfering with a work head, so that a dead zone does not exist and that the work is punched at high speed.

To achieve the object, a punching machine comprises a work head having a ram and a tool and moving in a direction of axis Y on a body frame, a first work movement positioning apparatus mounted at one side in the direction of axis X in a movable area of the work head in order to move and position the work in the direction of axis X, and a second work movement positioning apparatus mounted at the other side in the direction of axis X in order to move and position the work in the direction of axis X.

Accordingly, the work head comprising the ram and the tool which can move in the direction of axis Y is mounted on the body frame. The first and second work movement positioning apparatuses are mounted at both sides in the direction of axis X in the movable area of the work head, respectively. Thereby, it is possible to punch the work at high speed. Further, it is not necessary for the first and second work movement positioning apparatuses to enter into the movable area of the work head. Accordingly, it is possible to avoid interfering with the work head so that the dead zone does not exist.

In a particular embodiment, the first and second work positioning apparatuses comprise a carriage for axis X having a plurality of work clamps, a feed screw for moving a nut member integrated with the carriage for axis X, and a drive motor for rotating the feed screw, respectively.

Accordingly, the first and second work movement positioning apparatuses can be driven controlled individually. For example, while the work is positioned by the first or second work movement positioning apparatus, the second or first work movement positioning apparatus can be moved to an arbitrary work holding stand-by position in order to position the work.

The punching machine can further comprise a clutch mounted on the body frame so that the feed screws are engaged and disengaged by the clutch.

Accordingly, if necessary, each feed screw is engaged by the clutch means. Thereby, it is possible to rotate the feed screw by one drive motor in order to prolong a life span of the drive motor.

The punching machine can further comprise a plate holding clamp mounted on the body frame for holding the work.

Accordingly, it is possible to move the work smoothly from the side of the first work movement positioning apparatus to the side of the second work movement positioning apparatus.

A method of punching, in a punching machine having a work head including a ram and a tool and moving in a direction of axis Y on a body frame, a first work movement positioning apparatus mounted at one side in a direction of axis X in a movable area of the work head in order to move and position the work in the direction of axis X, and a second work movement positioning apparatus mounted at the other side in the direction of axis X in order to move and position the work in the direction of axis X, the method comprises the steps of: positioning the work by the first work movement positioning apparatus in order to punch the work; and next, moving the work from the first work movement positioning apparatus to the second work movement positioning apparatus so that the work is positioned by the second work movement positioning apparatus in order to continue punching the work.

Accordingly, the work is positioned in the direction of axis X by the first work movement positioning apparatus. Further, the work head is moved in the direction of axis Y in the movable area in order to punch the work. Next, the work is moved from the first work movement positioning apparatus to the second work movement positioning apparatus. The work is positioned by the second work movement positioning apparatus. The work head is moved in the direction of axis Y in the movable area in order to punch the work.

Accordingly, it is possible to punch the work at higher speed, compared to the conventional method. Further, the first and second work movement positioning apparatuses are not entered into the movable area where the work head is moved. Accordingly, the first and second work movement positioning apparatuses are not interfered with the work head. Further, there is not existed the dead zone where the work can not be punched.

The method can further comprise the step of: holding the work by the first and second work movement positioning apparatuses in order to punch the work.

Accordingly, the work head is moved in the direction of axis Y. The work is held by the first and second work movement positioning apparatuses in order to punch the work. Accordingly, a tension is applied to the work in order to punch the work so that it is possible to enhance a workability precision. Further, since the work is slightly raised in order to be moved, it is possible to avoid scratching the lower surface of the work.

The method can further comprise the step of: repeating positioning the work alternately by the first and second work movement positioning apparatuses in order to punch the work.

Accordingly, when the work head is moved in the direction of axis Y in order to punch the work, positioning the work is repeated alternately by the first and second work movement positioning apparatuses. Thereby, the work is moved in order to punch a longer work continuously.

The method can further comprise the step of: positioning the second or first work movement positioning apparatus to a work holding stand-by position while the work is held by the first or second work movement positioning apparatus in order to punch the work.

Accordingly, when a longer work is punched compared to a conventional method, the work is smoothly clamped and unclamped by the first and second work movement positioning apparatuses. Accordingly, it is possible to reduce a time for switching from clamping to unclamping of the work.

According to another embodiment of the invention, a method of punching, in a punching machine having a work head including a ram and a tool and moving in a direction of axis Y on a body frame, a first work movement positioning apparatus mounted at one side in a direction of axis X in a movable area of the work head in order to move and position the work in the direction of axis X, and a second work movement positioning apparatus mounted at the other side in the direction of axis X in order to move and position the work in the direction of axis X, the method comprises the steps of: positioning the work by the first and second work movement positioning apparatuses in order to bore the work when the work is moved forward in the direction of axis X; and next forming the work when the work is moved backward in the direction of axis X.

Accordingly, the work head is moved in the direction of axis Y in order to punch the work. First, the work is positioned by the first and second work movement positioning apparatuses when the work is moved forward in the direction of axis X in order to bore the work. Secondly, the work is formed when the work is moved backward in the direction of axis X. Thereby, since the formed rising portion is located in the direction far from the work head, it is possible to easily form the work partially upwardly as large as its height.

BEST MODE FOR CARRYING OUT THE INVENTION

Embodiments of the present invention are explained below in detail according to figures.

Figure 1:
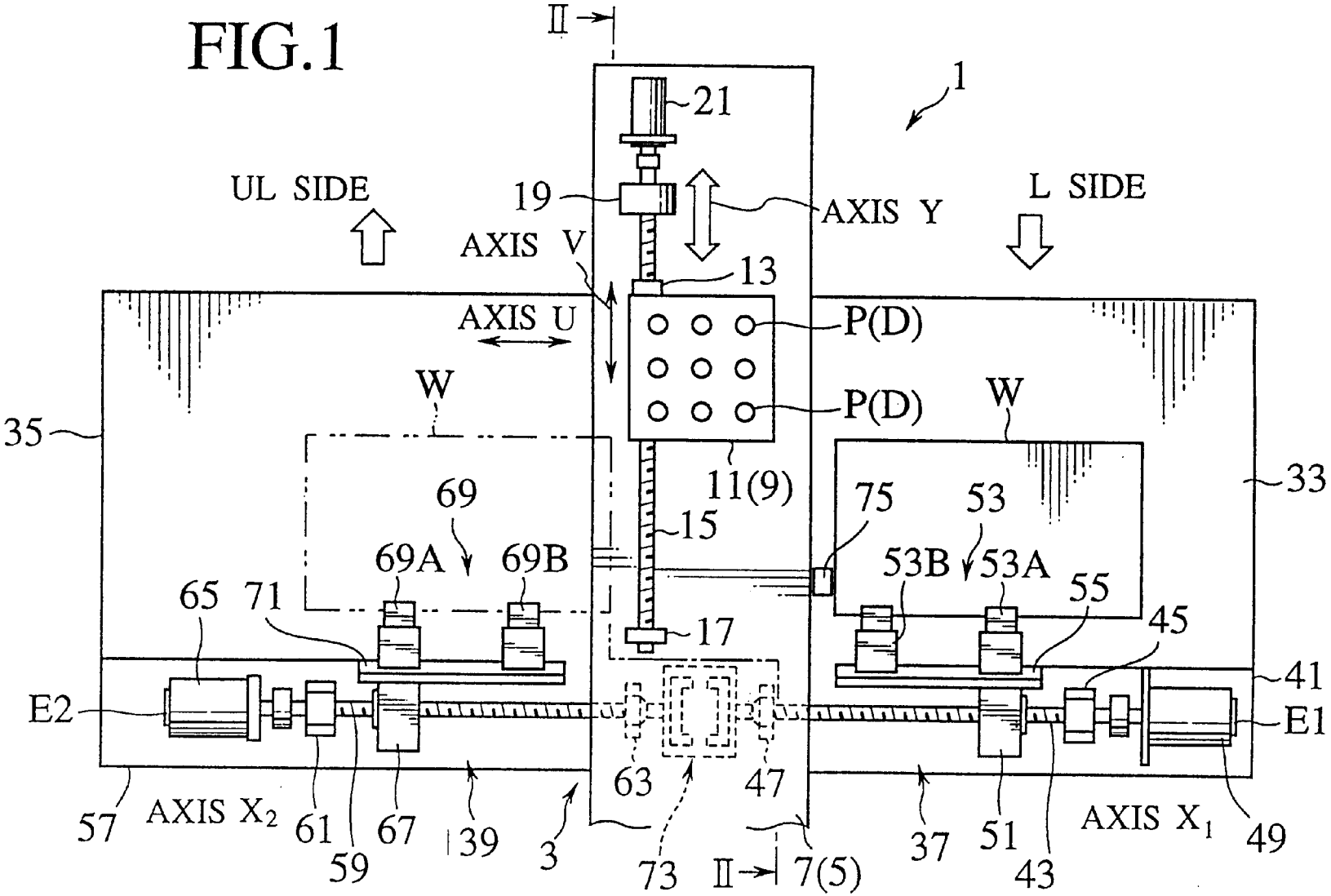
FIG. 1 shows a plan view of a punching machine according to an embodiment of the present invention.
Figure 2:
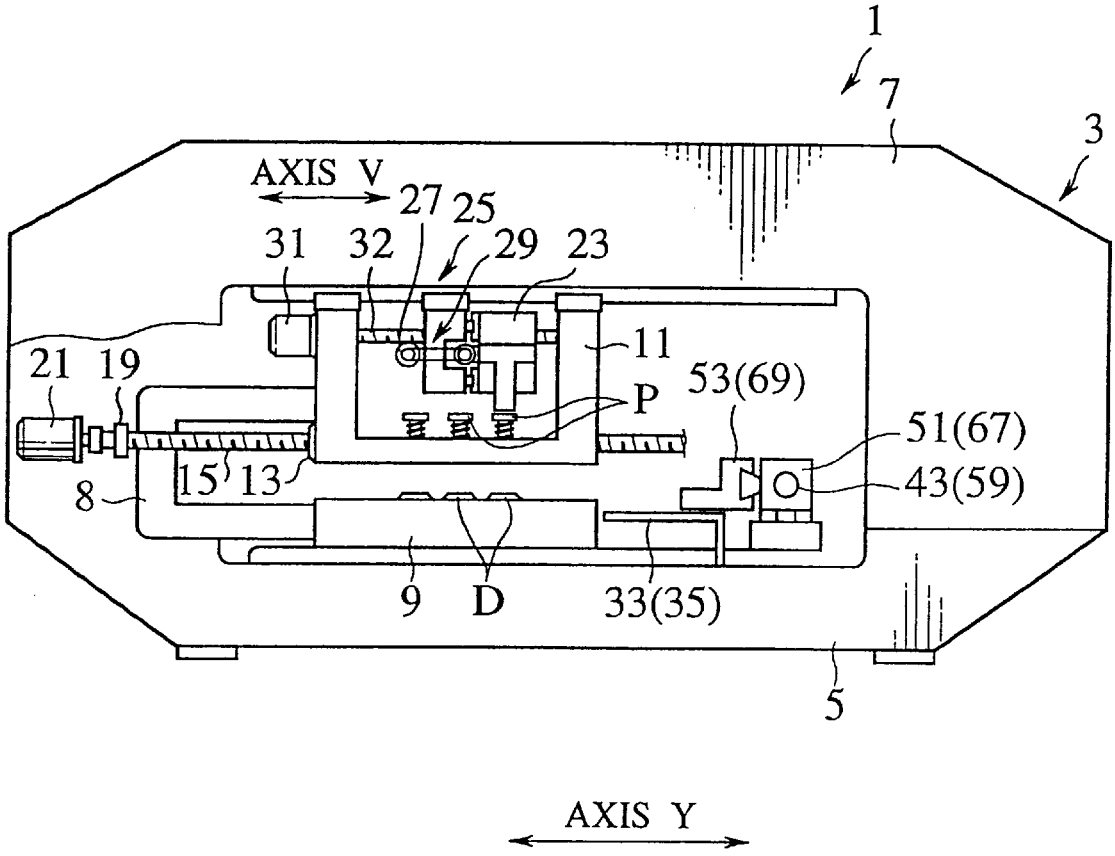
FIG. 2 shows an enlarged cross-sectional view taken along the line II—II in FIG. 1.

Referring to FIG. 1 and FIG. 2, a punching machine 1 comprises a gate-shaped body frame 3 which is standingly mounted. On the body frame 3, a lower frame 5 is integrated with an upper frame 7 by side frames. A C-shaped frame 8 is movably mounted between the lower frame 5 and the upper frame 7. A die block 9 and a punch block 11 mounting a plurality of dies D and punches P in rectangular arrangement, respectively, are faced with each other. The die block 9 and the punch block 11 are movably mounted at upper and lower portions on the C-shaped frame 8 in order to be moved in the direction of axis Y (upward and downward in FIG. 1).

A nut member 13 is integrated with the punch block 11. A ball screw 15 stretched in the direction of axis Y is thread-engaged with the nut member 13. The upper and lower portions (shown in FIG. 1) of the ball screw 15 is rotatably supported by bearings 17 and 19 in order to be rotated. The upper end (shown in FIG. 1) of the ball screw 15 is engaged with a drive motor 21 for axis Y.

According to the above construction, when the drive motor 21 for axis Y is driven, the ball screw 15 is rotated. Thereby, the punch block 11 is moved in the direction of axis Y through the nut member 13. The die block 9 is mounted on the C-shaped frame 8 to slide over the lower frame 5. Accordingly, when the punch block 11 is moved in the direction of axis Y, the die block 9 can also be moved in the direction of axis Y through the C-shaped frame 8. Further, the die block 9 and the punch block 11 may be moved individually by different drive motors. In this case, preferably, the drive motors are synchronously driven.

As shown in FIG. 2, a ram drive unit 25 comprising a ram apparatus 23 is mounted on the upper frame 7. The ram apparatus 23 is positioned at the upper position over each punch P mounted on the punch block 11 in rectangular arrangement. The ram apparatus 23 is movable in the directions of axis U and V which are same as the directions of axis X and Y, respectively. Further, the ram apparatus 23 comprises a hydraulic cylinder in order to be moved upward and downward. The ram apparatus 23 is moved in the direction of axis U by a drive motor 27 for axis U and a transmission mechanism 29 in the ram drive unit 25. Further, the ram apparatus 23 is moved in the direction of axis V by a drive motor 31 for axis V and a ball screw 32. The tool of the punch P and the die D, and the ram apparatus 23 are generally called as a work head.

According to the above construction, the ram apparatus 23 is positioned in the directions of axis U and V by the drive motor 27 for axis U and the drive motor 31 for axis V in the ram drive unit 25. Thereby, the ram apparatus 23 is positioned in the upper position over where a desired punch P is positioned. The ram apparatus 23 is operated so that the desired punch P is punched. Thereby, the punch P and the die D are co-acted with each other in order to punch a work W.

A front table 33 and a rear table 35 are mounted at both sides of the body frame 3. The work W which is due to be punched is set on the front table 33. The work W is moved in the direction of axis X (in the right and left direction in FIG. 1) from the front table 33 to the rear table 35.

A first work movement positioning apparatus 37 and a second work movement positioning apparatus 39 are mounted on the front table 33 and rear table 35, respectively. A clump base 41 of the first work movement positioning apparatus 37 is mounted at one side (at lower side in FIG. 1) of the front table 33. A ball screw 43 for axis $X_1$ stretched in the direction of axis $X_1$ is mounted on the clump base 41. The right portion of the ball screw 43 for axis $X_1$ is rotatably supported by a bearing 45 mounted on the clump base 41 in order to be rotated. The left portion of the ball screw 43 for axis $X_1$ is rotatably supported by a bearing 47 mounted on the lower frame 5 in order to be rotated.

A drive motor 49 for axis $X_1$ such as a servo-motor etc. having an absolute-encoder E1 is engaged with the right end of the ball screw 43 for axis $X_1$. A nut member 51 for axis $X_1$ is thread-engaged with the ball screw 43 for axis $X_1$. The nut member 51 for axis $X_1$ is integrated with a carriage 55 for axis $X_1$ comprising work clamps 53A and 53B as a plurality of first work clamp apparatuses 53.

According to the above construction, when the drive motor 49 for axis $X_1$ is driven, the ball screw 43 is rotated. Accordingly, the work clamps 53A and 53B of the first work clamp apparatus 53 are moved in the direction of axis $X_1$ through the nut member 51 for axis $X_1$ and the carriage 55 for axis $X_1$.

A clump base 57 of the second work movement positioning apparatus 39 is mounted at one side (at lower side in FIG. 1) of the rear table 35. A ball screw 59 for axis $X_2$ stretched in the direction of axis $X_2$ is mounted on the clump base 57. The left portion of the ball screw 59 for axis $X_2$ is rotatably supported by a bearing 61 mounted on the clump base 57 in order to be rotated. The right portion of the ball screw 59 for axis $X_2$ is rotatably supported by a bearing 63 mounted on the lower frame 5 in order to be rotated.

A drive motor 65 for axis $X_2$ such as a servo-motor etc. having an absolute-encoder E2 is engaged with the left end of the ball screw 59 for axis $X_2$. A nut member 67 for axis $X_2$ is thread-engaged with the ball screw 59 for axis $X_2$. The nut member 67 for axis $X_2$ is integrated with a carriage 71 for axis $X_2$ comprising work clamps 69A and 69B as a plurality of second work clamp apparatuses 69.

According to the above construction, when the drive motor 65 for axis $X_2$ is driven, the ball screw 59 is rotated. Accordingly, the work clamps 69A and 69B of the second work clamp apparatus 69 are moved in the direction of axis $X_2$ through the nut member 67 for axis $X_2$ and the carriage 71 for axis $X_2$.

The work clamps 53A and 53B of the first work clamp apparatus 53 and the work clamps 69A and 69B of the second work clamp apparatus 69 are constructed by a structure shown, for example, in FIG. 2 of a Japanese Patent Publication No. 2-37468. The structure comprises a position adjusting mechanism (clamp positioner) for clamping a work W and for adjusting a position of the clamp. Thereby, it is possible to adjust a position.

The left end of the ball screw 43 for axis $X_1$ and the right end of the ball screw 59 for axis $X_2$ can be engaged and disengaged by, for example, an electromagnetic clutch 73 as clutch means mounted onthelowerframe5. A locate pin 75 for axis X is protrusibly retractably mounted near the side of the body frame 3 on the front table 33 by a cylinder etcetra.

Figure 3:
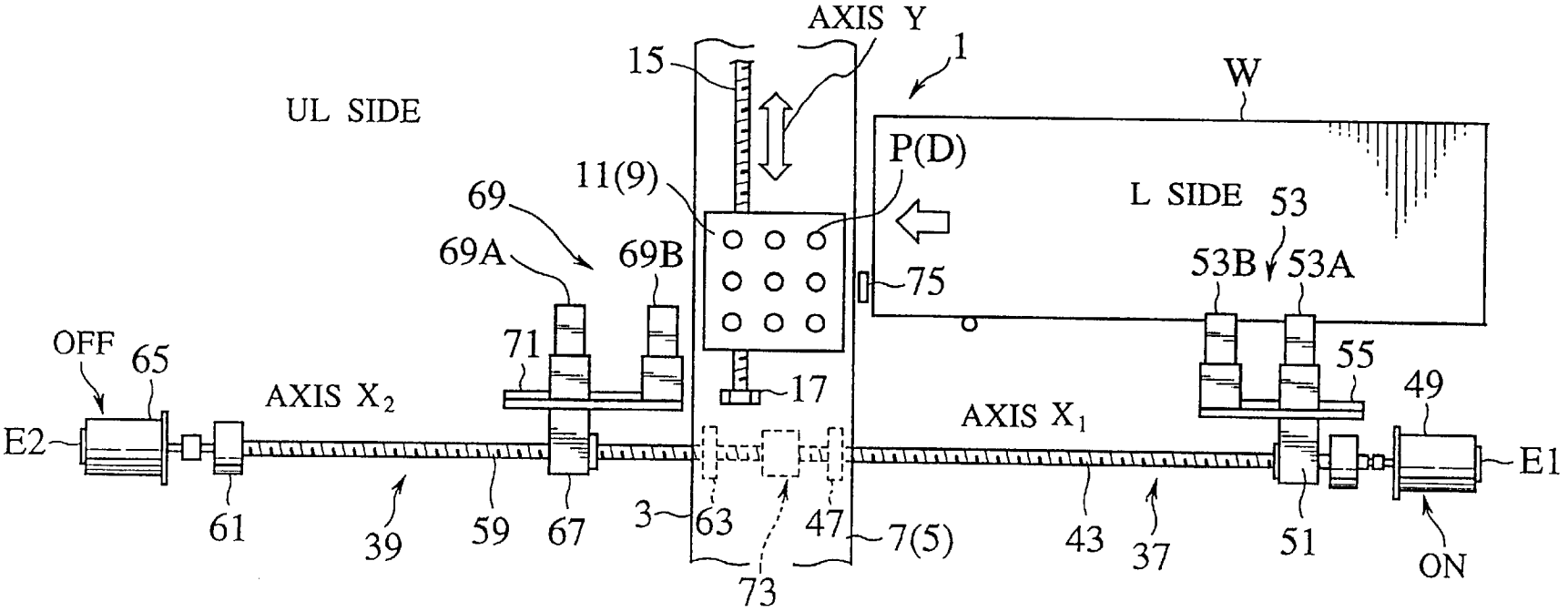
FIG. 3 shows a schematic diagram explaining an operation of the present invention.
Figure 4:
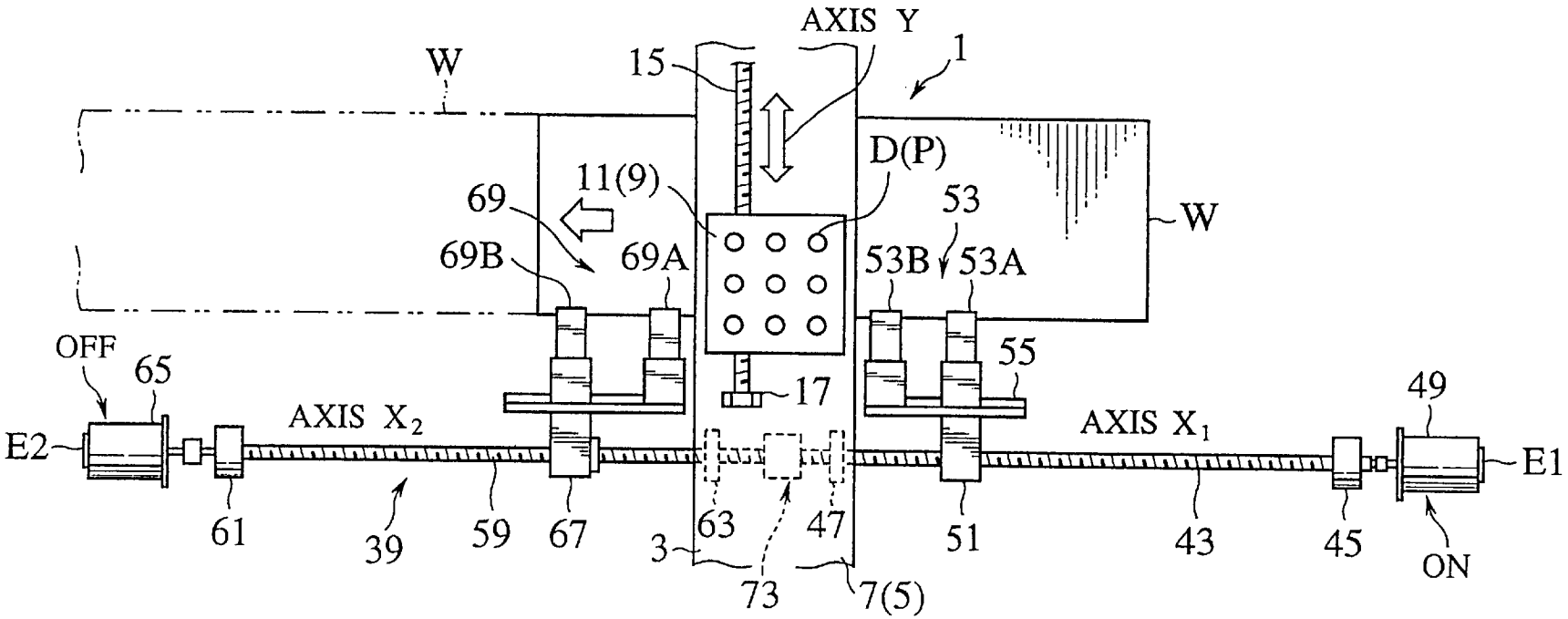
FIG. 4 shows a schematic diagram explaining an operation of the present invention.

An operation for punching the work W by the punching machine 1 is explained according to FIG. 3 and FIG. 4. Firstly, as shown in FIG. 2, the work W is transmitted onto the front table 33 at the L side (at the side of loading). The work W is positioned by a location of the locate pin 75 for axis X and of the work clamps 53A and 53B. Secondly, the work W is clumped by the work clamps 53A and 53B, then the punching starts.

That is, the drive motor 49 for axis $X_1$ is driven in order to rotate the ball screw 43 for axis $X_1$. Thereby, the work W clamped by the work clamps 53A and 53B through the nut member 51 for axis $X_1$ and the carriage 55 for axis $X_1$ is moved at the left side in FIG. 3. The punch P and the die D are co-acted with each other in order to punch the work W at a desired position. Since the electromagnetic clutch 73 is not engaged, the drive motor 65 for axis $X_2$ is not driven.

The work W is punched so that the work W can be reached at the side of axis $X_2$, that is, at the side of the rear table 35, as shown in FIG. 4. The work W is clamped by the work clamps 53A, 53B, and the work clamps 69A, 69B. That is, while the work clamps 53A, 53B, and 69A, 69B are being repositioned, the work W is transmitted.

In this state, the electromagnetic clutch 73 is engaged, the drive motor 65 for axis $X_2$ is driven. Thereby, the ball screw 59 for axis $X_2$ is rotated so that the ball screw 43 for axis $X_1$ can also be rotated. Accordingly, the work W is subsequently being punched in order to be moved at the left side in FIG. 4. The drive motor 49 for axis $X_1$ is turned off in order to be free. Further, the work W is punched in order to be positioned at the position shown by two chain dots line in FIG. 4. Since the work W is held by only the work clamps 69A and 69B, the electromagnetic clutch 73 is able to be disengaged. Since the work W can be punched on only axis $X_2$, the work W can be transmitted without interfering with the work head. Further, it is possible to punch throughout the work W.

A next work W is loaded and is laid on an origin where the axis $X_1$ is positioned at an origin, so that the loading of the next work W is completed. The work W is in order to be positioned. That is, during punching the previous work W, the next work W is positioned in order to be loaded. Accordingly, it is possible to realize higher workability relative to the total working lot.

Figure 5:
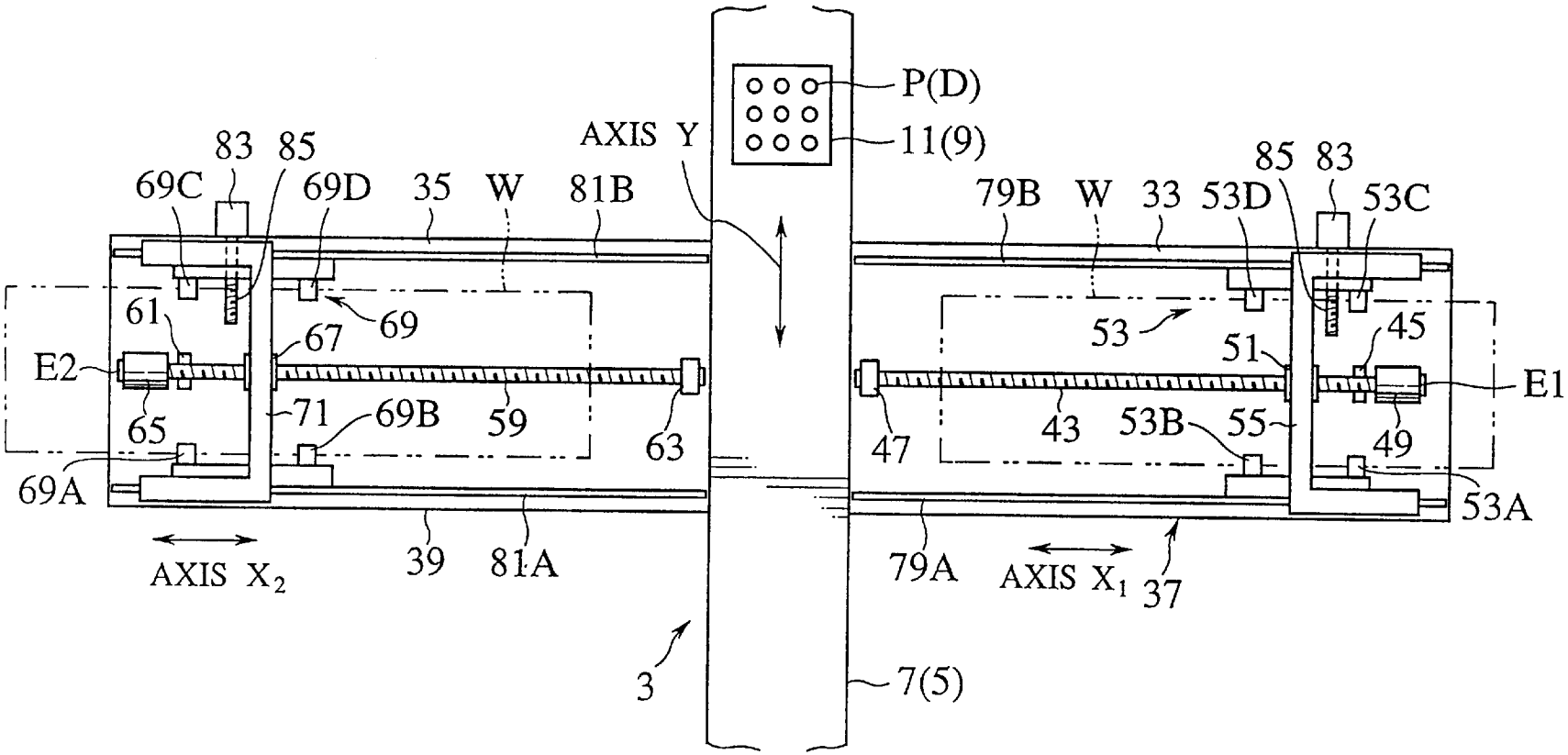
FIG. 5 shows a plan view of a first and second work movement positioning apparatuses in FIG. 1 according to another embodiment of the present invention.

FIG. 5 shows an another embodiment alternative to the first and second work movement positioning apparatuses in FIG. 1. The elements having the same reference numbers in FIG. 5 are the same portions in FIG. 1. Accordingly, the detailed explanation of the same portions is omitted. The different portions are explained below.

Guide rails 79A and 79B stretched in axis $X_1$ in the first work movement positioning apparatus 37 are laid at the front and rear side (the upper and lower side) of the front table 33. Guide rails 81A and 81B stretched in axis $X_2$ in the second work movement positioning apparatus 39 are laid at the front and rear side (the upper and lower side) of the rear table 35. The lower portion at the front and rear side of a gate-shaped carriage 55 for axis $X_1$ is mounted on the guide rails 79A and 79B in order to be slid in the direction of axis $X_1$. The lower portion at the front and rear side of a gate-shaped carriage 71 for axis $X_2$ is mounted on the guide rails 81A and 81B in order to be slid in the direction of axis $X_2$.

Work clamps 53A, 53B, 53C, 53D as the first work clamp apparatus 53 are mounted at the lower portion at front and rear side of the carriage 55 for axis $X_1$. Work clamps 69A, 69B, 69C, 69D as the second work clamp apparatus 69 are mounted at the lower portion at front and rear side of the carriage 71 for axis $X_2$ According to the above construction, the work W is clamped by the work clamps 53A, 53B, 53C, 53D in order to be positioned in the direction of axis $X_1$. Further, the work W is clamped by the work clamps 69A, 69B, 69C, 69D in order to be positioned in the direction of axis $X_2$. The rest construction in FIG. 5 is same as the construction in FIG. 1. Accordingly, a detailed explanation is omitted. Accordingly, the work W is clamped front and rear, and right and left by the work clamps 53A, 53B, 53C, 53D and 69A, 69B, 69C, 69D or the work clamps 53B, 53D, 69B, 69D. Thereby, the tension can be applied to the work W so that it is possible to enhance workability precision. Further, it is possible to move the work W at high speed. Furthermore, since it is possible to slightly raise the work W in order to be moved, it is possible to avoid scratching the lower surface of the work W by the die D.

The work clamps 53A, 53B, 69A, 69B among the work clamps 53A to 53D and 69A to 69D are fixed. It is possible to move the work clamps 53C, 53D, 69C, 69D in the front and rear direction (upward and downward in FIG. 5) by a drive mechanism such as a drive motor 83 and a ball screw 85. Thereby, it is possible to correspond to the variation relative to a length of shorter side of the work W.

Next, another method of punching the work W by using the above punching machine 1 is explained below.

Figure 6A:
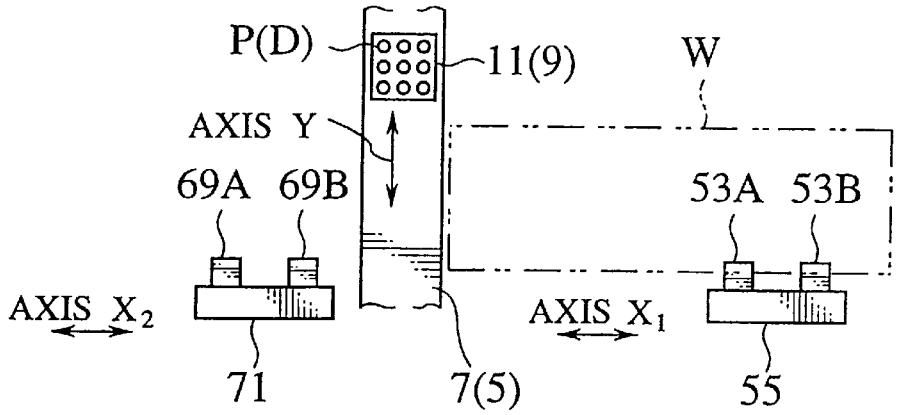
FIGS. 6A, 6B and 6C show schematic diagrams explaining an example of a method of the present invention.

For example, as shown in FIG. 6A, the side of the right end of a long work W is clamped by the work clamps 53A, 53B. The work W is moved at the left side in the direction of axis $X_1$ so that the punch block 11 and the die block 9 can be moved in the direction of axis Y. It is possible to operate a desired punching relative to the work W.

Figure 6B:
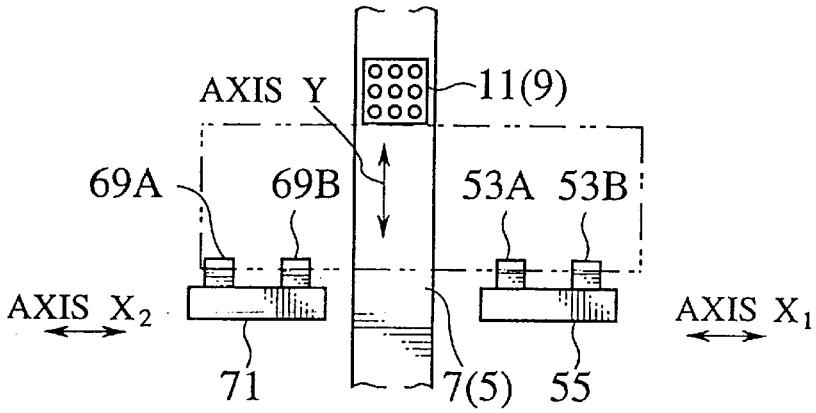

When the work clamps 53A, 53B is reached at a position shown in FIG. 6B, the side of the left end of the work W is clamped by the work clamps 69A, 69B. Further, the work W is unclamped by the work clamps 53A, 53B. The work W clamped by the work clamps 69A, 69B is moved at the left side on axis $X_2$. The punch block 11 and the die block 9 can be moved in the direction of axis Y so that the work W is punched. It is possible to punch throughout the total work W. The work clamps 53A, 53B are returned to where they were. The work clamps 53A, 53B are returned to the work holding stand-by position, so that the work clamps 53A, 53B are in stand-by state in order to punch the next work W.

Accordingly, the work clamps 53A, 53B, 69A, 69B are not entered into the movable area where the punch block 11 and the die block 9 can move in the direction of axis Y. Therefore, it is possible to prevent the work clamps from interfering with the work W. Further, it is possible to punch the portion clamped by the work clamps 53A, 53B, 69A, 69B. Accordingly, the dead zone does not exist so that it is possible to punch the work W at high speed.

Figure 7A:
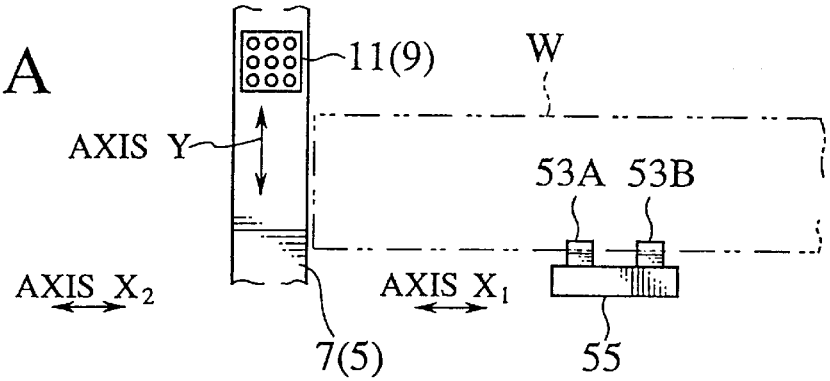
FIGS. 7A, 7B, 7C and 7D show schematic diagrams explaining an example of a method of the present invention.
Figure 7B:
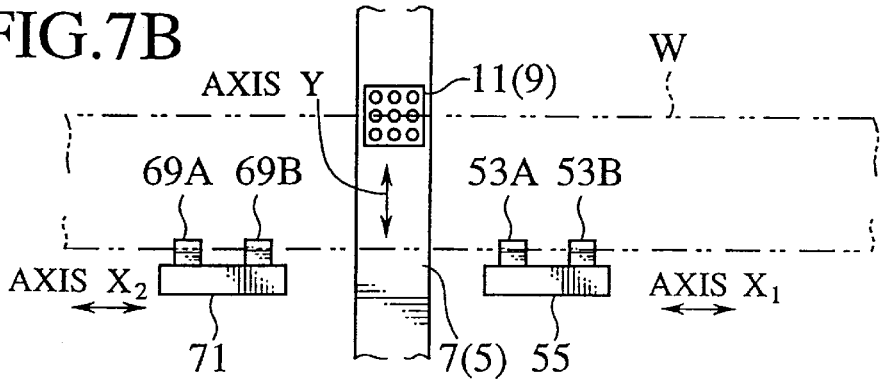
Figure 7C:
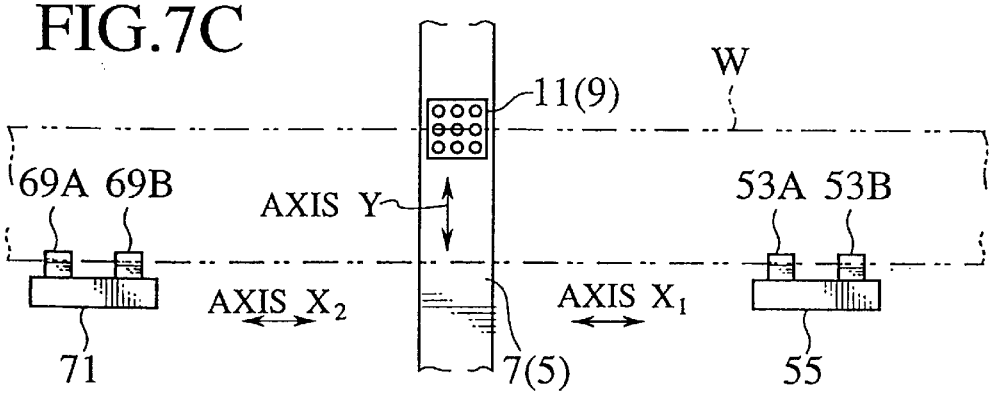

As shown in FIG. 7A, when the work W is very long, the work W is clamped by the work clamps 53A, 53B. The work W is moved at the left side on axis $X_1$ in order to punch the work W. Next, as shown in FIG. 7B, the work W is clamped by the work clamps 69A, 69B. The work W is unclamped by the work clamps 53A, 53B. As shown in FIG. 7C, the work clamps 69A, 69B is moved at the left side in the direction of axis $X_2$ in order to be punched. While the work W is punched, the work clamps 53A, 53B are returned to where they were. Thereby, the work W is clamped.

Figure 7D:
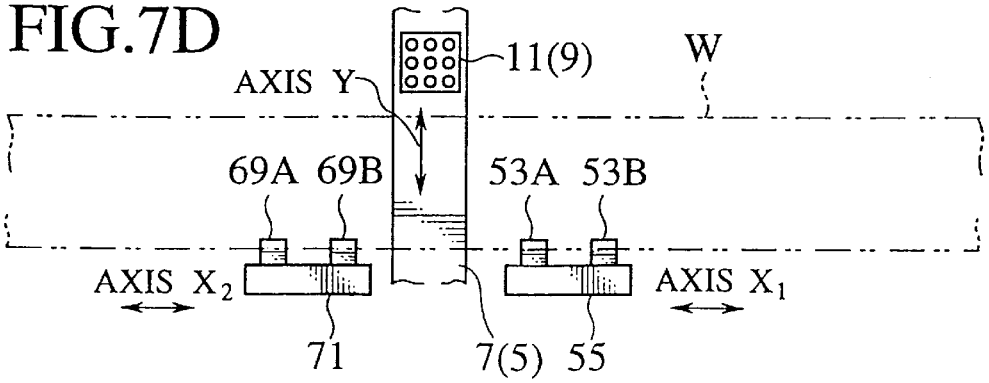

The work clamps 69A, 69B are unclamped at the position shown in FIG. 7C. As shown in FIG. 7D, the work clamps 53A, 53B are moved at the left side in the direction of axis $X_1$ in order to punch the work W. When the work clamps 53A, 53B are reached at the position as shown in FIG. 7D, the work clamps 53A, 53B are unclamped. The work W is clamped by the work clamps 69A, 69B. The work W is moved at the left side in the direction of axis $X_2$ in order to punch the work W.

Thus, the work W is clamped alternately by the work clamps 53A, 53B and 69A, 69B. The work W is moved at the left side in the direction of axis $X_2$ and $X_1$ in order to punch the work W. Thereby, it is possible to punch the very long work W, for example, even a coil member, continuously at high speed.

Figure 6C:
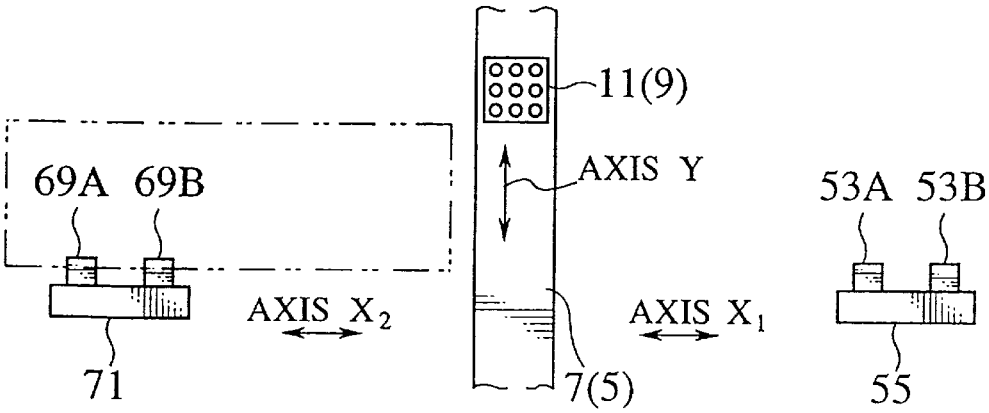

In the process shown in FIGS. 6A, 6B and 6C, for example, the work W is bored. After then, in FIG. 6C, the work clamps 69A, 69B are moved at the right side in the direction of axis $X_2$. The punch block 11 and the die block 9 are moved in the direction of axis Y in order to form the work W. In FIG. 6B, the work clamps 69A, 69B are unclamped. The work clamps 53A, 53B are clamped so that the work W is moved at the right side in the direction of axis $X_1$, as shown in FIG. 6A. Thereby, it is possible to form the work W.

Thus, the work clamps 53A, 53B are moved at the left side in the direction of axis $X_1$ in order to bore the work W. The work clamps 69A, 69B are moved at the left side in the direction of axis $X_2$ in order to bore the work W. Further, the work clamps 69A, 69B are moved forward at the right side in the direction of axis $X_2$ in order to form the work W. The work clamps 53A, 53B are moved forward at the right side in the direction of axis XI in order to form the work W. Thereby, since the formed rising portion is located in the direction far from the punch block 11, it is possible to punch the work W easily as large as its height.

The present invention is not restricted to the above embodiments. The appropriate variation and deformation may be applied to other embodiments.

Industrial Applicability

As understood by the above embodiments, the punching machine comprises the work head having the ram and the tool and moving in a direction of axis Y on a body frame, the first and second work movement positioning apparatuses mounted at both sides in a direction of axis X in a movable area of the work head. Thereby, it is possible to punch the work at high speed. Since the first and second work movement positioning apparatuses are not entered into the movable area of the work head, it is possible to prevent from interfering with the work head. Further, the dead zone does not exist.

The first and second work movement positioning apparatuses can be driving controlled individually. For example, while the work is positioned by the first or second work movement positioning apparatus, the second or first work movement positioning apparatus can be moved to an arbitrary work holding stand-by position in order to position the work.

If necessary, each feed screw is engaged by a clutch. Thereby, it is possible to rotate the feed screw by one drive motor in order to prolong a life span of the drive motor.

It is possible to move the work smoothly from the side of the first work movement positioning apparatus to the side of the second work movement positioning apparatus.

The work can be positioned in the direction of axis X by the first work movement positioning apparatus. Further, the work head is moved in the direction of axis Y in the movable area in order to punch the work. Next, the work is moved from the first work movement positioning apparatus to the second work movement positioning apparatus. The work is positioned by the second work movement positioning apparatus. The work head is moved in the direction of axis Y in the movable area in order to punch the work.

Accordingly, it is possible to punch the work at higher speed, compared to the conventional method. Further, the first and second work movement positioning apparatuses are not entered into the movable area where the work head is moved. Accordingly, the first and second work movement positioning apparatuses is not interfered with the work head. Further, there is not the dead zone where the work can not be punched.

The work head can be moved in the direction of axis Y. The work is held by the first and second work movement positioning apparatuses in order to punch the work. Accordingly, a tension is applied to the work in order to punch the work so that it is possible to enhance a workability precision. Further, since the work is slightly raised in order to be moved, it is possible to avoid scratching the lower surface of the work.

The work head is moved in the direction of axis Y in order to punch head the work, positioning the work can be repeated alternately by the first and second work movement positioning apparatuses. Thereby, the work is moved in order to punch a longer work continuously.

When a longer work is punched compared to a conventional method, the work can be smoothly clamped and unclamped by the first and second work movement positioning apparatuses. Accordingly, it is possible to reduce a time for switching from clamping to unclamping of the work.

The work head can be moved in the direction of axis Y in order to punch the work. First, the work is positioned by the first and second work movement positioning apparatuses when the work is moved forward in the direction of axis X in order to bore the work. Next, the work is formed when the work is moved backward in the direction of axis X. Thereby, since the formed rising portion is located in the direction far from the work head, it is possible to easily form the work partially upwardly as large as height.

What is claimed is:

1. A punching machine comprising:

a body frame having a table, the table supporting a workpiece to be worked;

a first positioning device mounted on the table, the first positioning device positioning the workpiece in a first direction, the first positioning device including a first ball screw;

a second positioning device mounted on the table, the second positioning device positioning the workpiece in the first direction, the second positioning device including a second ball screw;

a working head mounted in the body frame so as to be positioned in a second direction perpendicular to the first direction to punch the workpiece; and a clutch connecting the first ball screw to the second ball screw so that the first and second positioning devices transfer the workpiece in the first direction simultaneously, wherein the first positioning device and the second positioning device are arranged in series in the first direction.

2. A punching machine comprising:

a body frame having a table, the table supporting a workpiece to be worked;

a first positioning device mounted on the table, the first positioning device positioning the workpiece in a first direction, the first positioning device including a first ball screw;

a working head mounted in the body frame so as to be positioned in a second direction perpendicular to the first direction to punch the workpiece;

a second positioning device mounted on the table, the second positioning device positioning the workpiece in the first direction, the second positioning device including a second ball screw; and a clutch connecting the first ball screw to the second ball screw so that the first and the second positioning devices transfer the workpiece in the first direction simultaneously; wherein the workpiece is sheet shaped material uncoiled from a coiled material.

* * * * *